US012702914B2

(12) United States Patent
Morvan et al.

(10) Patent No.: US 12,702,914 B2
(45) Date of Patent: Aug. 11, 2026

(54) GROUND-CONTACT DEVICE COMPRISING A POLE AND A POLE STRAP

(71) Applicant: SKIS ROSSIGNOL, Saint-Jean-de-Moirans (FR)

(72) Inventors: Thomas Morvan, Le Gua (FR); Gilles Leray, Steinbrunn-le-Bas (FR)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 331 days.

(21) Appl. No.: 18/591,637

(22) Filed: Feb. 29, 2024

(65) Prior Publication Data

US 2024/0293728 A1 Sep. 5, 2024

(30) Foreign Application Priority Data

Mar. 1, 2023 (FR) ..... 2301887

(51) Int. Cl.
*A63C 11/22* (2006.01)

(52) U.S. Cl.
CPC ..... *A63C 11/2224* (2020.08)

(58) Field of Classification Search
CPC ... A63C 11/2224; A63C 11/222; A63C 11/22; A63C 11/227
See application file for complete search history.

(56) References Cited

U.S. PATENT DOCUMENTS 5,549,330 A * 8/1996 Wells ..... A63C 11/2224 280/822
8,079,617 B2 * 12/2011 Lenhart ..... A45B 9/02 280/821
8,579,329 B2 * 11/2013 Lenhart ..... A63C 11/2224 280/821
8,678,020 B2 3/2014 Renaud-Goud et al.
2009/0174178 A1 7/2009 Lenhart
2011/0079256 A1 4/2011 Renaud-Goud et al.

FOREIGN PATENT DOCUMENTS

DE 7804728 U1 6/1978
DE 202017100469 U1 * 2/2017 ..... A63C 11/227
DE 202017101413 U1 * 3/2017 ..... A63C 11/2224
EP 1970105 A1 * 9/2008 ..... A63C 11/2224

OTHER PUBLICATIONS

French Search Report and Written Opinion dated Oct. 23, 2023 in priority application No. FR 2301887; with English machine translation (total 19 pages).

* cited by examiner

*Primary Examiner* — John D Walters
(74) *Attorney, Agent, or Firm* — Seckel IP, PLLC

(57) ABSTRACT

The ground-contact device (1) includes a pole (2) provided with a handgrip (5), a pole strap (3) provided with a connecting element (7) intended to be fastened removably to the handgrip, and a locking element (11) mobile relative to the handgrip (5) between a locked position and an unlocked position, the locking element having a body (14) and a retaining element (25) connected to the body (14) and able to immobilize the connecting element relative to the handgrip when the locking element is in the locked position, the connecting element being free relative to the handgrip when the locking element is in the unlocked position, and a first retaining surface (19) connected to said body (14) by an elastic portion (22).

20 Claims, 7 Drawing Sheets

GROUND-CONTACT DEVICE COMPRISING A POLE AND A POLE STRAP

CROSS-REFERENCE TO RELATED APPLICATIONS

This application claims priority of French patent application No. FR2301887 filed Mar. 1, 2023, the content of which is hereby incorporated by reference herein in its entirety.

TECHNICAL FIELD OF THE INVENTION

The invention relates to a ground-contact device comprising a pole provided with a handgrip and a pole strap provided with a connecting element intended to be attached removably to the handgrip. The ground-contact device may notably be intended for the pursuit of cross-country skiing, Alpine skiing, ski trekking, Nordic ski walking or even mountain racing.

BACKGROUND ART

In the pursuit of various sports such as Alpine skiing, cross-country skiing, ski trekking, Nordic ski walking and mountain racing, poles are used to gain purchase by bearing contact with the ground. In order to make the grasp on the pole more secure and/or to improve the transfer of power to the ground, the poles are equipped with a pole strap which is intended to be slipped around the wrist and/or the hand of a user. These pole straps may notably take the form of a strip of fabric, possibly attached to a glove.

In order to make poles equipped with a pole strap easier to use, it is known practice for the attachment of the pole strap to the pole to be made removable. The user can then detach themselves from the pole while keeping the pole strap attached to their hand and/or to their wrist. Publications EP2883583A1 and FR3080750A1 disclose such poles equipped with a removable pole strap.

SUMMARY OF THE INVENTION

The devices known from the prior art for removably fastening the pole strap to the pole do nevertheless have disadvantages:

- In certain instances, these fastening devices need to be manipulated with two hands, and this presents a major disadvantage since the user has to manipulate the fastening means while they have a pole attached to each hand.
- In other instances, the fastening devices demand a great deal of dexterity in their manipulation, and this is particularly troublesome when the user is wearing gloves or when their fingers are numb.
- The removable fastening devices comprise numerous parts and/or comprise parts of complex shape and are therefore difficult to manufacture and to assemble. This complexity also leads to an increased risk of these fastening devices malfunctioning during the course of their use.

The aim of the invention is to provide a ground-contact device that overcomes the above disadvantages and improves the ground-contact devices known from the prior art.

More specifically, a first object of the invention is a ground-contact device that is simple to manufacture, robust and simple to manipulate.

The invention relates to a ground-contact device comprising a pole provided with a handgrip, and a pole strap provided with a connecting element intended to be fastened removably to the handgrip, the ground-contact device comprising a locking element that is mobile relative to the handgrip between a locked position and an unlocked position, the locking element comprising:

- a body,
- a retaining element connected to the body and able to immobilize the connecting element relative to the handgrip when the locking element is in the locked position, the connecting element being free relative to the handgrip when the locking element is in the unlocked position, and
- a first retaining surface connected to said body by an elastic portion, the handgrip comprising a second retaining surface interacting with the first retaining surface in order to keep the locking element in the locked position, the handgrip comprising an opening intended to accept the locking element, said second retaining surface being formed on one edge of said opening.

The ground-contact device may comprise an appendage on which said first retaining surface is formed, the appendage further comprising a first bearing surface intended to be actuated by a user in order to move the first retaining surface away from the second retaining surface.

Said appendage may be connected to the body by said elastic portion.

Said opening may be a through-opening passing right through the handgrip.

The locking element may comprise a second bearing surface intended to be actuated by a user in order to move the locking element from its unlocked position to its locked position.

The first bearing surface may be situated at a first end of the opening, and the second bearing surface may be situated at a second end of the opening, the second end being opposite the first end.

The first bearing surface may be configured to be actuated using the index finger and/or the thumb of one hand of a user, the other digits of that same hand being wrapped around the handgrip. The second bearing surface may be configured to be actuated using the thumb and/or the index finger of one hand of a user, the other digits of that same hand being wrapped around the handgrip.

Said elastic portion may be an elastic leaf.

Said retaining element may have the form of a finger intended to be inserted in a hole formed in the connecting element.

The ground-contact device may comprise a stop surface configured to limit the flexing of the elastic portion.

The locking element may be a one-piece element.

The locking element may be translationally mobile relative to the handgrip between its locked position and its unlocked position.

The ground-contact device may comprise mechanical-connection means configured to hold the locking element on the handgrip.

The ground-contact device may comprise a pin secured to the handgrip, and the locking element may comprise an oblong opening interacting with the pin to limit the amplitude of movement of the locking element relative to the handgrip.

The invention also relates to a ground-contact device comprising a pole provided with a handgrip, and a pole strap provided with a connecting element intended to be fastened removably to the handgrip, the ground-contact device comprising a locking element that is mobile relative to the handgrip between a locked position and an unlocked position, the locking element comprising:

a body, a retaining element connected to the body and able to immobilize the connecting element relative to the handgrip when the locking element is in the locked position, the connecting element being free relative to the handgrip when the locking element is in the unlocked position, and a first retaining surface connected to said body by an elastic portion, the handgrip comprising a second retaining surface interacting with the first retaining surface in order to keep the locking element in the locked position, the locking element comprising an appendage on which said first retaining surface is formed, the appendage further comprising a first bearing surface intended to be actuated by a user in order to move the first retaining surface away from the second retaining surface, the first bearing surface being a manual-actuation surface accessible to the digits of the hand.

BRIEF DESCRIPTION OF THE DRAWINGS

These objects, features and advantages of the present invention will be explained in detail in the following description of a particular non-limiting embodiment, with reference to the accompanying figures, in which.

DETAILED DESCRIPTION OF PARTICULAR EMBODIMENTS

Figure 1:
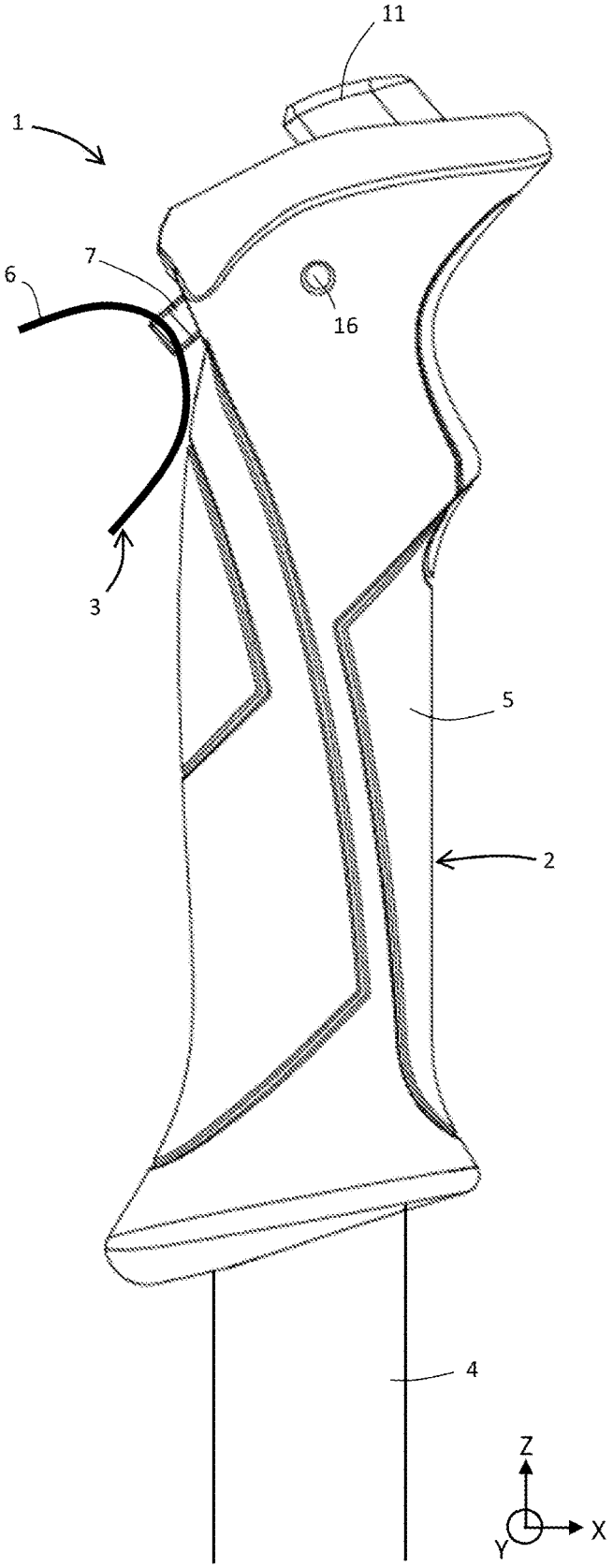
FIG. 1 is a view in profile of a ground-contact device according to a first embodiment of the invention.
Figure 2:
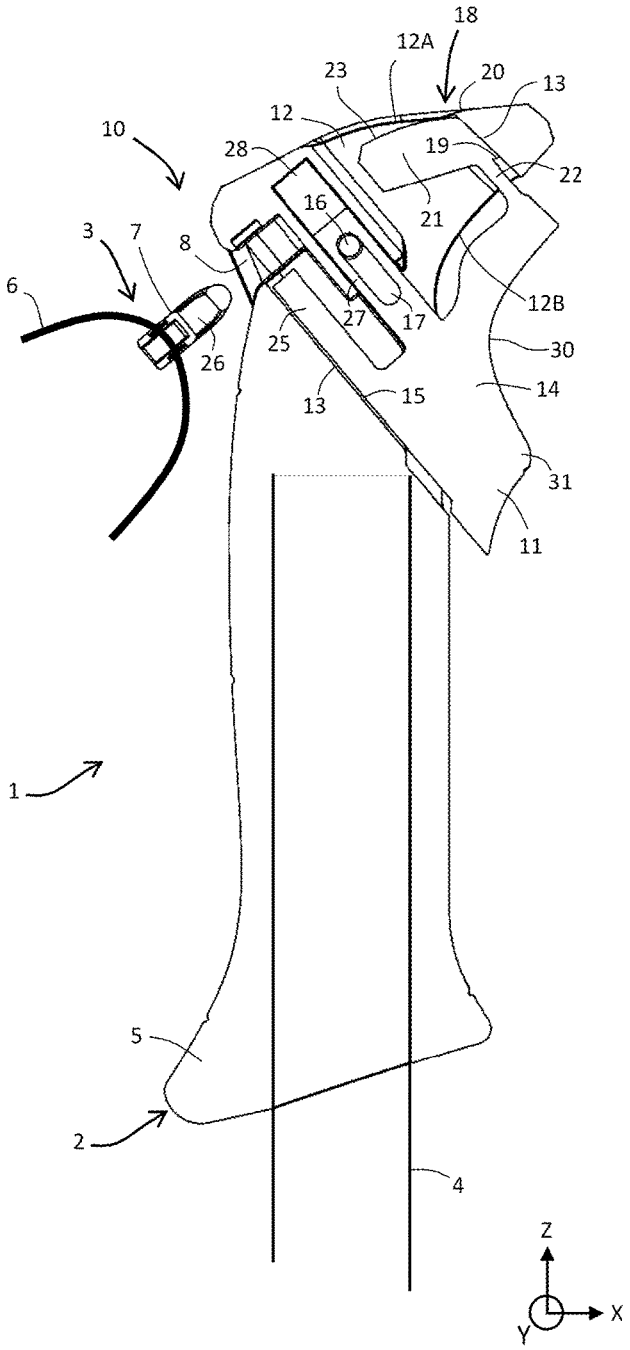
FIG. 2 is a cross-sectional view in profile of a fastening device of the ground-contact device of FIG. 1, a locking element of the fastening device being in the unlocked position.
Figure 3:
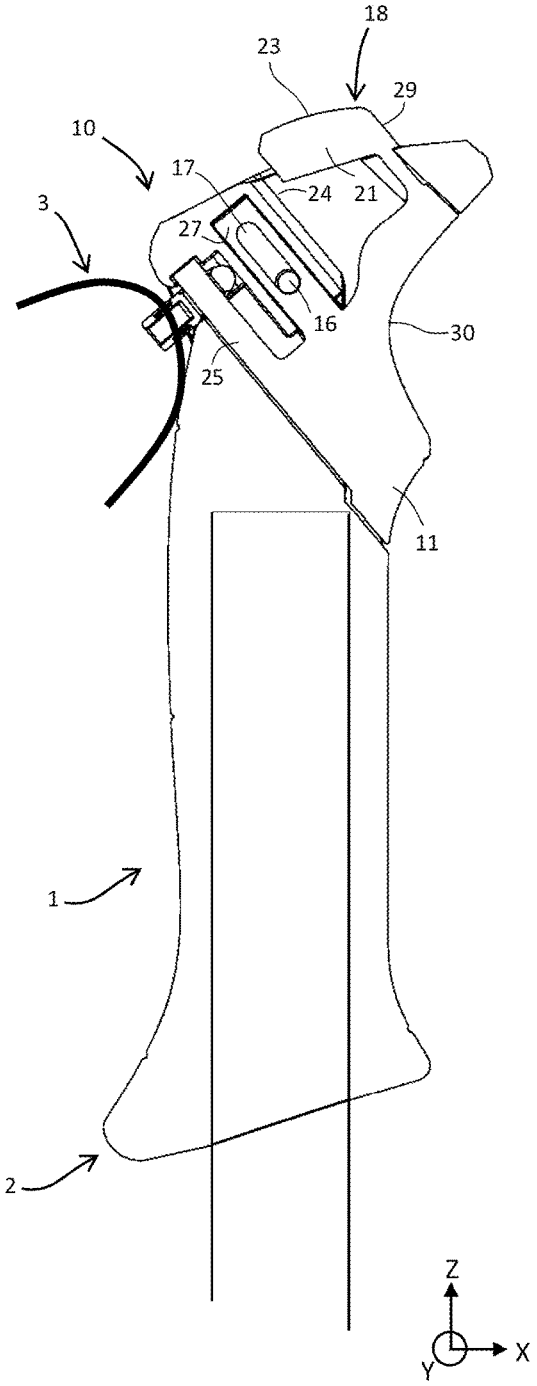
FIG. 3 is a cross-sectional view in profile of the fastening device of FIG. 2, the locking element being in the locked position.

FIGS. 1, 2 and 3 illustrate a ground-contact device 1 according to a first embodiment of the invention. The ground-contact device 1 comprises a pole 2 and a pole strap 3 able to be fastened removably to the pole 2. The pole 2 is intended to be grasped in the hand of a user in order to gain purchase by bearing on the ground. The pole 2 comprises a tubular part 4 surmounted by a handgrip 5. The tubular part 4 may be equipped with a spike or with a ferrule intended to come into contact with the ground. The spike or the ferrule is positioned at the opposite end of the tubular part 4 from the handgrip 5. The pole 2 may be intended for the pursuit of gliding sports such as Alpine skiing and/or ski trekking and/or cross-country skiing. It may also be intended for the pursuit of cross-country skiing and/or Nordic ski walking and/or mountain racing. The pole 2 is considered to extend parallel to a vertical axis Z. The vertical axis Z is oriented from bottom to top. The terms "above" or "below" relate to an arrangement along the vertical axis Z. The terms "front" and "rear" are defined in relation to a longitudinal axis X, perpendicular to the vertical axis Z and parallel to the direction in which a user of the ground-contact device is progressing in a straight line. The longitudinal axis X is oriented from the rear to the front. The rear of the pole refers to that side of the pole that faces towards the pole strap 3 (and therefore also towards the forearm of the user), and the front of the pole refers to the opposite side of the pole to the pole strap. The transverse axis Y is an axis perpendicular to the longitudinal axis X and the vertical axis Z.

The pole strap 3 is depicted schematically in FIGS. 1, 2 and 3. The pole strap 3 comprises an attachment means 6 intended to be attached to the wrist and/or to the hand of the user. This attachment means 6 may for example be a strap, intended to adopt a position on the hand and/or on a glove. The attachment means 6 may equally be integrated into the glove. This glove may be perforated. The attachment means 6 may comprise parts made of fabric and/or of plastic. The pole strap 3 further comprises a connecting element 7, or connector 7, configured to interact with a first opening 8 situated at the rear of the handgrip 5 of the pole 2 so as to fasten the pole strap 3 to the pole 2 reversibly. The connecting element 7 is secured to the attachment means 6. The connecting element 7 may notably be stitched, bonded, tied or else fusion bonded to the attachment means 6.

The first opening 8, best visible in FIGS. 2 and 3, may have a shape that complements the shape of the connecting element 7. It may comprise an entrance facing towards the rear of the pole 2. The first opening 8 faces the user. The first opening 8 may comprise guide surfaces, notably in the form of ramps, facilitating the insertion of the connecting element 7.

A fastening device 10 is configured to connect the pole strap 3 removably to the pole 2. The fastening device 10 comprises the handgrip 5 and the connecting element 7 which were mentioned hereinabove, as well as a locking element 11. The locking element is mobile relative to the handgrip 5 between a locked position (illustrated in FIG. 3) and an unlocked position (illustrated in FIG. 2). The connecting element 7 is able to be immobilized relative to the handgrip 5, notably inside the first opening 8, when the locking element is in the locked position. Conversely, the connecting element 7 is free to exit the first opening 8 when the locking element 11 is in the unlocked position. The handgrip 5, the connecting element 7 and the locking element 11 are three distinct elements of the fastening device 10.

The handgrip 5 comprises a second opening 12 inside which the locking element 11 is situated. The second opening 12 is notably a through-opening. The second opening 12 therefore comprises a first end 12A and a second end 12B which are distinct from one another. The periphery of the first end 12A is connected to the periphery of the second end 12B by a set of internal walls 13 belonging to the handgrip 5. In other words, the second opening 12 forms a tunnel passing right through the handgrip 5 of the pole 2. The first end 12A may be located on an upper face of the handgrip 5, and the second end 12B may be located on a front face of the handgrip 5.

The first opening 8 and the second opening 12 are both situated in the upper part of the handgrip 5, above a surface via which the handgrip is grasped. The axis along which the first opening 8 extends may be substantially perpendicular to the axis along which the second opening 12 extends. These two openings 8 and 12 communicate with one another in order to allow the connecting element 7 to interact with the locking element 11.

The locking element 11 is able to move within the second opening 12 between its locked position and its unlocked position. In particular, the locking element 11 is able to move in a translational movement. The locking element 11 is notably able to move in a plane parallel to the longitudinal axis X and to the vertical axis Z between its locked position and its unlocked position. The locking element 11 notably comprises a body 14 provided with external walls 15 which are intended to slide against the internal walls 13 of the second opening 12 of the handgrip.

Advantageously, the fastening device 10 comprises mechanical-connection means configured to hold the locking element 11 on the handgrip 5. Thus, the locking element 11 remains attached to the handgrip 5 and is not at risk of being lost. In particular, said mechanical-connection means comprise stop means configured to limit the amplitude of movement of the locking element 11 relative to the handgrip 5. As illustrated in FIGS. 2 and 3, these stop means may comprise, on the one hand, a pin 16, for example in the form of a shaft parallel to the transverse axis Y and, on the other hand, an oblong opening 17 interacting with the pin 16. The pin 16 is secured to the handgrip 8 and the oblong opening 17 is formed in the locking element 11. The oblong opening 17 has an oval shape of which the width corresponds substantially to the diameter of the pin 16 and the length is equal to the desired travel for the locking element 11 in order to pass from its locked position to its unlocked position. Alternatively or in addition, stop means may be formed by mating reliefs situated on the internal walls 13 of the second opening 12 and the external walls 15 of the locking element 11.

Advantageously, the fastening device 10 may be made up of just three elements, these being the handgrip 5, the connecting element 7 and the locking element 11. The pin 6 may potentially form a fourth element of the fastening device 10. In all instances, the fastening device 10 is therefore particularly simple to manufacture and to assemble. In particular, the fastening device 10 comprises no spring or equivalent return means. All of the elements of the fastening device 10 may advantageously be made from injection-moulded plastic. The pin 16 may potentially be a metal shaft.

The locking element 11 comprises a fastening clip 18 provided with a first retaining surface 19. The handgrip 5 comprises a second retaining surface 20 interacting with the first retaining surface 19 in order to keep the locking element 11 in the locked position. The fastening clip 18 comprises an appendage 21 connected to the body 14 by an elastic portion 22 such as an elastic tab or an elastic leaf. The first retaining surface 19 is formed on one face of the appendage 21. The second retaining surface 20 is formed on one edge of the second opening 12, particularly at a front edge of the first end 12A of the opening 12. The second retaining surface 20 is notably formed on part of an exterior face of the handgrip, particularly on the upper face of the handgrip according to the first embodiment illustrated. When the locking element 11 is in the locked position, the appendage 21 projects above the upper face of the handgrip 5. The appendage is thus easily accessible to the user.

According to one embodiment, the elastic portion could be embodied by any distinct elastic means situated between the appendage 21 and the body 14. The elastic means could for example be a spiral spring, a helical spring, or else a leaf spring. The elastic means could also be an element made from a resilient material such as rubber.

The first retaining surface 19 extends facing the second retaining surface 20, which forms a stop preventing the locking element 11 from moving towards its unlocked position. When the locking element 11 is in the locked position, the overlapping of the retaining surfaces 19 and 20 may be by the order of a few millimetres. This overlap may be relatively small insofar as the retaining surfaces 19 and 20 are not subjected to any load when a user applies thrust to the pole 2 via the pole strap 3.

The elastic portion 22 is able to flex enough to move the first retaining surface 19 away from the second retaining surface 20 without breaking or suffering permanent deformation. The fastening clip 18 comprises a first bearing surface 23 intended to be actuated by the user in order to move the first retaining surface 19 away from the second retaining surface 20. The first bearing surface 23 is a manual-actuation surface accessible to the digits of the hand, from the outside of the handgrip. Moving the first retaining surface 19 away from the second retaining surface 20 then allows the locking element to be moved from its locked position into its unlocked position.

Advantageously, the fastening clip 18 may be configured in such a way as to cause the locking element to move automatically towards its unlocked position when the first retaining surface is moved away from the second retaining surface. This may be achieved through the action of the elastic portion 22 on the internal wall 13 of the second opening 12. Thus, in order to cause the locking element to pass into the unlocked position, the user need merely move the two retaining surfaces 19 and 20 the one away from the other.

The appendage 21 further comprises a guide surface 29 bearing against the internal wall 13 when the locking element 11 is in the unlocked position, and when the locking element 11 is sliding inside the second opening 12. The elastic portion 22 is under tension when the guide surface 29 is bearing against the internal wall 13. When the locking element 11 reaches its locked position, the release of the tension in the elastic portion 22 causes the retaining surfaces 19 and 20 to overlap and causes the locking element 11 to become immobilized. The bearing of the guide surface 29 against the internal wall 13 also stabilizes the unlocked position of the unlocking element.

The first bearing surface 23 is formed on an upper face of the appendage 21. In particular, the first bearing surface 23 projects above an upper face of the handgrip 5 when the locking element 11 is in the locked position. The first bearing surface 23 is situated in such a way that pressure on it causes the elastic portion 22 to flex. According to the embodiment illustrated in FIGS. 2 and 3, the first bearing surface 23 is intended to be actuated with the thumb of the hand of a user, the other digits of that hand being wrapped around the handgrip. The first bearing surface 23 is therefore easily accessible while holding the pole 2.

Advantageously, the fastening device 10 comprises a stop surface 24 configured to limit the flexing of the elastic portion 22. This makes it possible to prevent the user from damaging the elastic portion 22 by pressing too firmly on the first bearing surface 23. Advantageously, this stop surface 24 is formed by an internal wall 13 of the second opening 12.

The body 14 of the locking element 11 may comprise a retaining element 25 intended to interact with the connecting element 7. The retaining element 25 is able to retain the connecting element 7 when the locking element 11 is in its locked position. In particular, the retaining element 25 may take the form of a first finger. In particular, the first finger may be intended to be inserted in a hole 26 formed in the connecting element 7. The first finger formed on the body of the locking element 11 interacts directly with the complementary hole 26 formed in the connecting element. When the locking element 11 is in the locked position, the first finger passes through the first opening 8. One wall of the first opening 8 may comprise a housing accommodating the end of the first finger so as to support the first finger and thus prevent any flexing of the first finger when the user applies a strong pulling force to the pole strap 3. The body 14 of the locking element 11 may also comprise a second finger 27 in which the oblong opening 17 is formed. The second finger 27 may slide in a housing 28 formed in the handgrip 5 and opening into the second opening 12. The first finger 25 and the second finger 27 may extend parallel to the axis along which the locking element 11 slides between its locked position and its unlocked position. The elastic portion 22 may also extend parallel to the axis along which the locking element 11 slides between its locked position and its unlocked position. The second finger 27 is situated between the retaining element 25 and the elastic portion 22.

The locking element 11 further comprises a second bearing surface 30, distinct from the first bearing surface 23, and intended to be actuated by the user in order to move the locking element 11 from its unlocked position to its locked position. The locking of the pole strap 3 to the pole 2 is therefore a manual rather than an automatic operation. The user thus maintains full control over the locking of the pole strap 3. In addition, there is no need to provide a return means or a complex mechanism for automatically moving the locking element into the locked position. The fastening device 10 therefore remains simple to manufacture and to assemble.

The second bearing surface 30 is formed on a front face of the body 14 of the locking element 11. This front face extends in the upper part of the handgrip 5 substantially opposite the index finger of the user when said user is holding the pole 2. The user can therefore easily move the locking element into its locked position by a pressure from the index figure as if pulling a trigger, with the other digits of the hand being wrapped around the handgrip 5.

The first bearing surface 23 is situated at the first end 12A of the second opening 12, and the second bearing surface 30 is situated at the second end 12B of the second opening 12. The second bearing surface 30 may have a rounded shape conforming to the shape of the curled index finger. The second bearing surface 30 may have a protrusion 31 separating the index finger from the middle finger of the hand, making for an easier grasp.

In order to manufacture the ground-contact device 1, a handgrip 5 obtained by injection-moulding of plastic is push-fitted onto a tubular part 4. Next, the locking element 11 may be inserted into the second opening 12 via the second end 12B thereof until it reaches the locked position. Finally, the pin 16 may be inserted into the handgrip in order to secure the locking element relative to the handgrip 5. Moreover, the connecting element 7 may be fastened to the attachment means 6 in order to form a pole strap 3. The ground-contact device 1 is therefore particularly quick and simple to manufacture.

In order to use the ground-contact device, a user may slip on the pole strap 3 and then insert the connecting element 7 into the first opening 8. Advantageously, the connecting element 7 is fastened to the attachment means 6 in such a way that the user can easily guide the connecting element 7 into the first opening 8 with the attachment means 6 already slipped over their hand. The connecting element 7 is fastened to the attachment means 6 in such a way as to become positioned between the thumb and index finger of the hand. Thus, the connecting element 7 positions the pole strap and the hand as close as possible to the handgrip. Thereafter, once the connecting element is in place in the first opening 8, the user may grasp the pole and apply pressure with the index finger to the second bearing surface 30 so as to move the locking element into its locked position. Activation of the fastening clip 18 may generate a noise and/or a sensation indicating to the user that the locking element 11 has indeed reached its locked position. The user can then pursue any activity with no fear of dropping the pole on the ground. Said user may also apply pressure to the pole 2 via the pole strap 3 without the need to grip the handgrip 5. Thereafter, when the user wishes to detach their hand from the pole 2, they need merely press the first bearing surface 23 downwards with their thumb. In so doing, the elastic portion 22 flexes and the retaining surfaces 19 and 20 are moved away from one another. The locking element 11 may then be moved into its unlocked position. The movement of the locking element 11 into the unlocked position may be obtained by thumb pressure on the first bearing surface 23 and/or by a reactive force of the appendage 21 on the internal wall 13 of the second opening 12.

Figure 4:
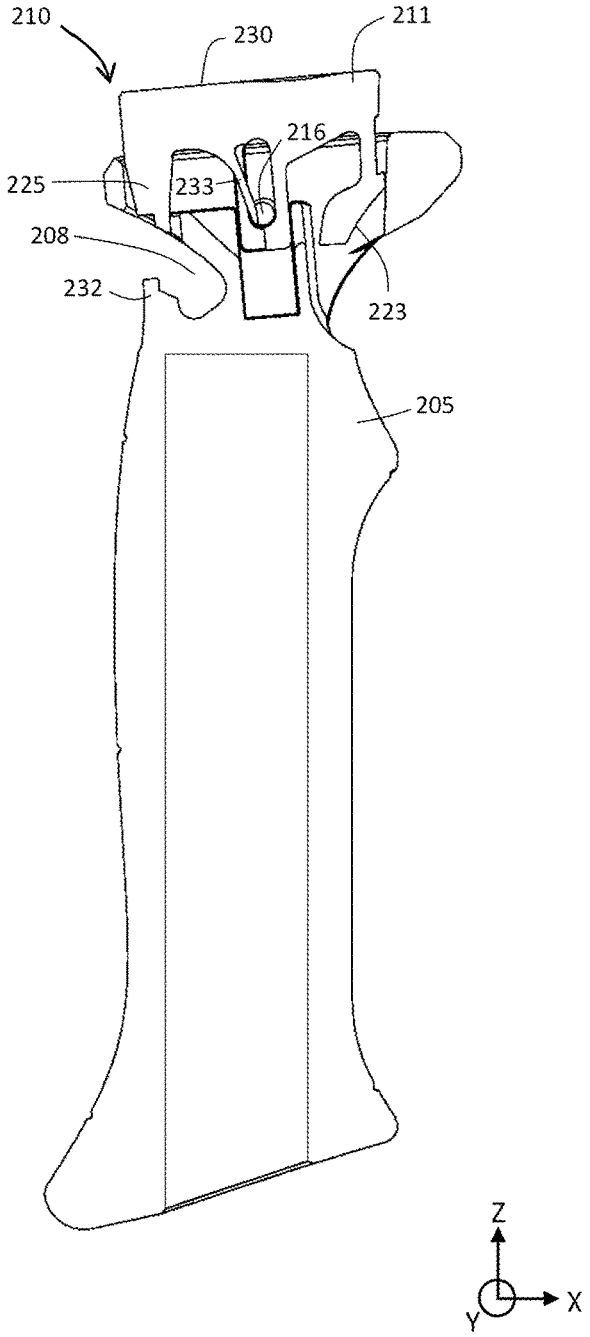
FIG. 4 is a cross-sectional view in profile of a fastening device according to a second embodiment of the invention, a locking element of the fastening device being in the unlocked position.
Figure 5:
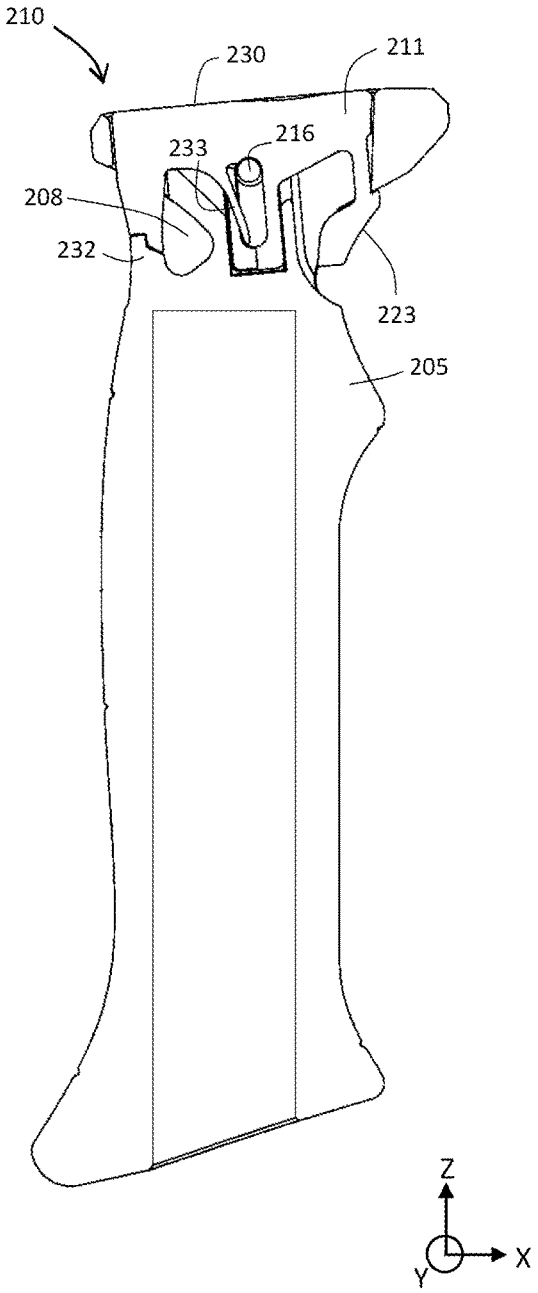
FIG. 5 is a cross-sectional view in profile of the fastening device of FIG. 4, the locking element being in the locked position.
Figure 6:
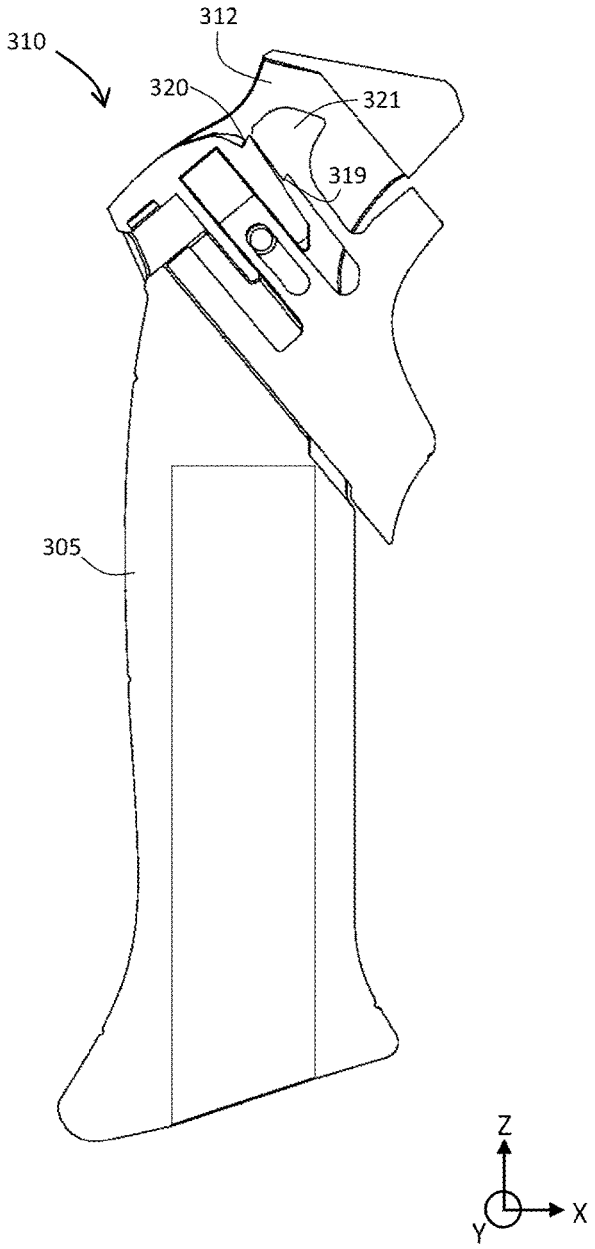
FIG. 6 is a cross-sectional view in profile of a fastening device according to a third embodiment of the invention, a locking element of the fastening device being in the unlocked position.
Figure 7:
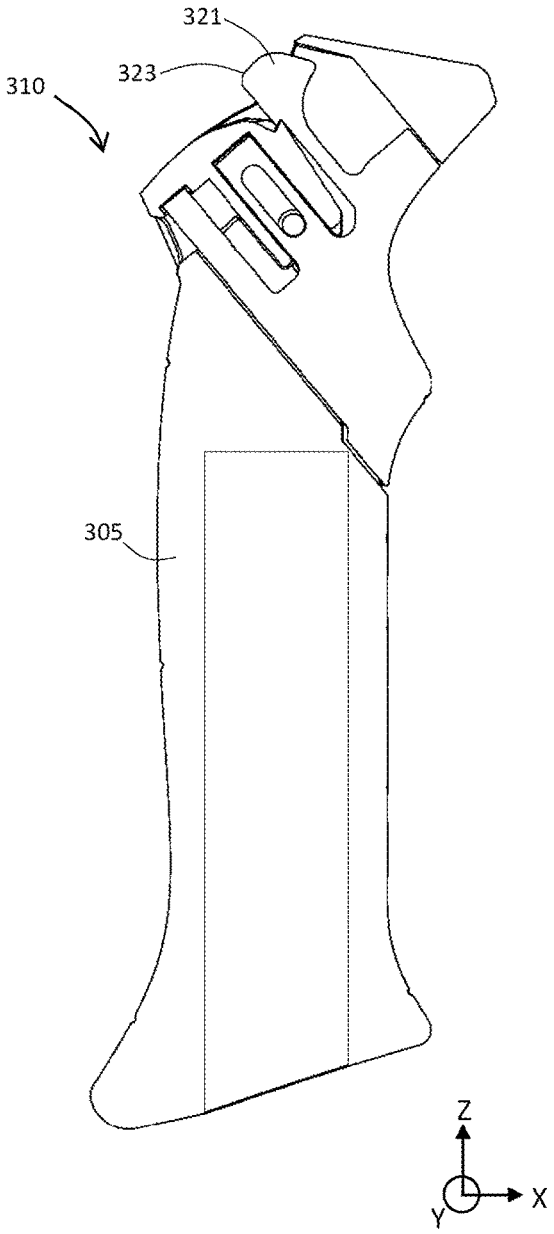
FIG. 7 is a cross-sectional view in profile of the fastening device of FIG. 6, the locking element being in the locked position.
Figure 8:
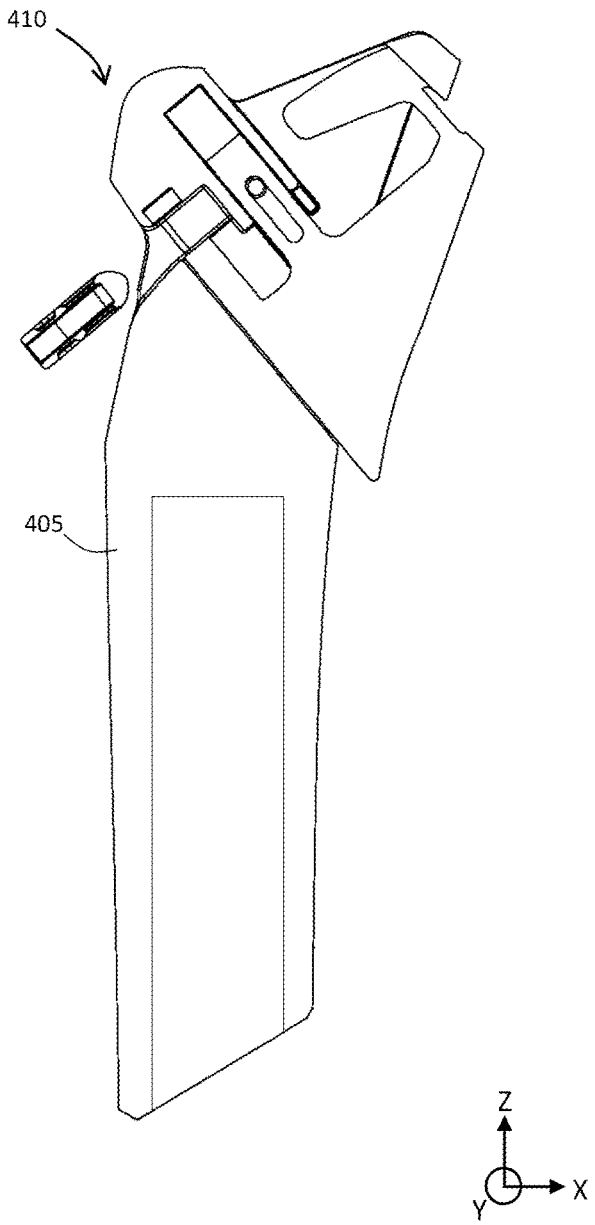
FIG. 8 is a cross-sectional view in profile of a fastening device according to a fourth embodiment of the invention, a locking element of the fastening device being in the unlocked position.
Figure 9:
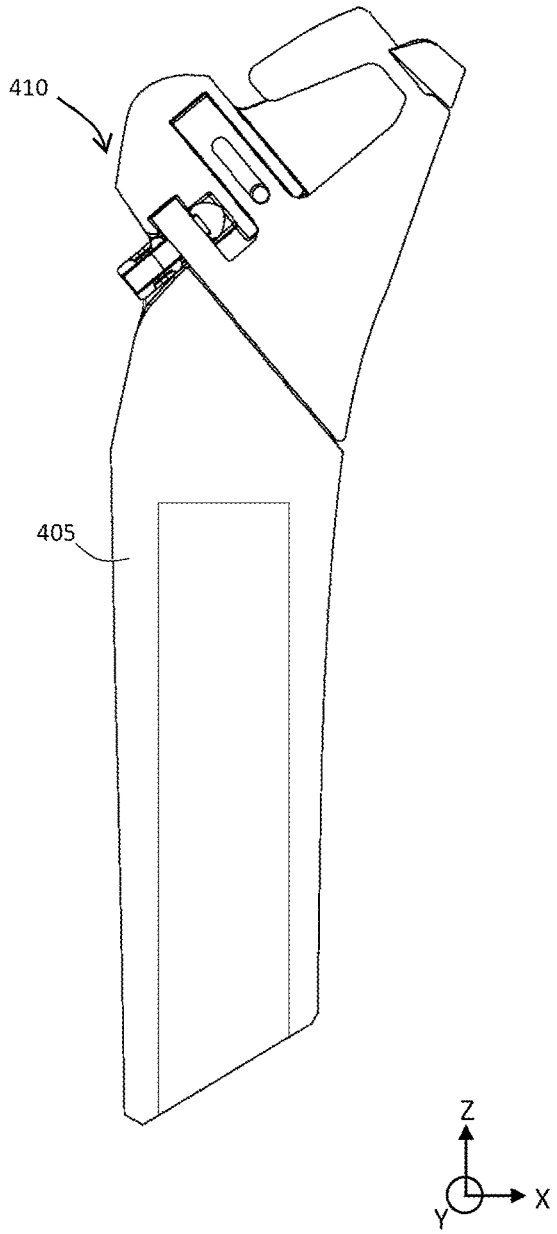
FIG. 9 is a cross-sectional view in profile of the fastening device of FIG. 8, the locking element being in the locked position.
Figure 10:
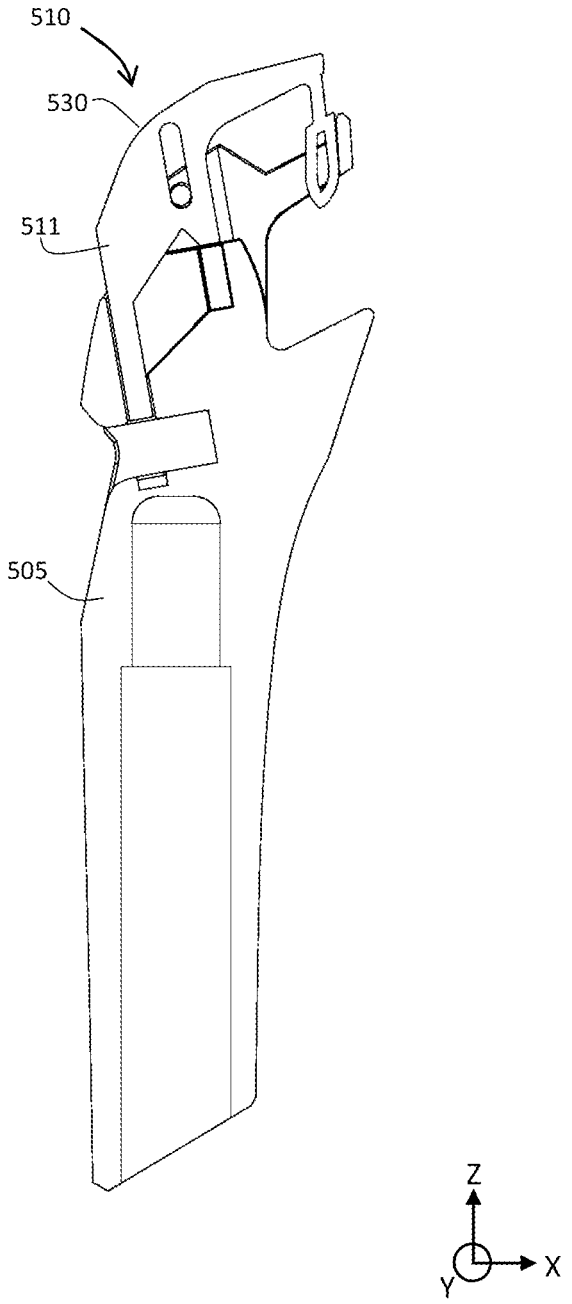
FIG. 10 is a cross-sectional view in profile of a fastening device according to a fifth embodiment of the invention, a locking element of the fastening device being in the unlocked position.
Figure 11:
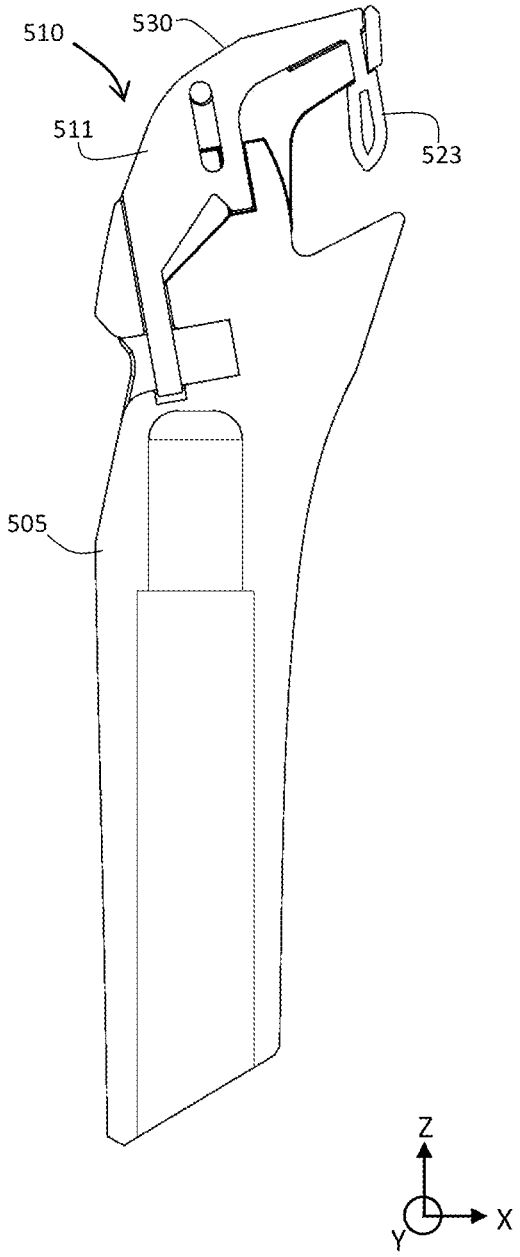
FIG. 11 is a cross-sectional view in profile of the fastening device of FIG. 10, the locking element being in the locked position.
Figure 12:
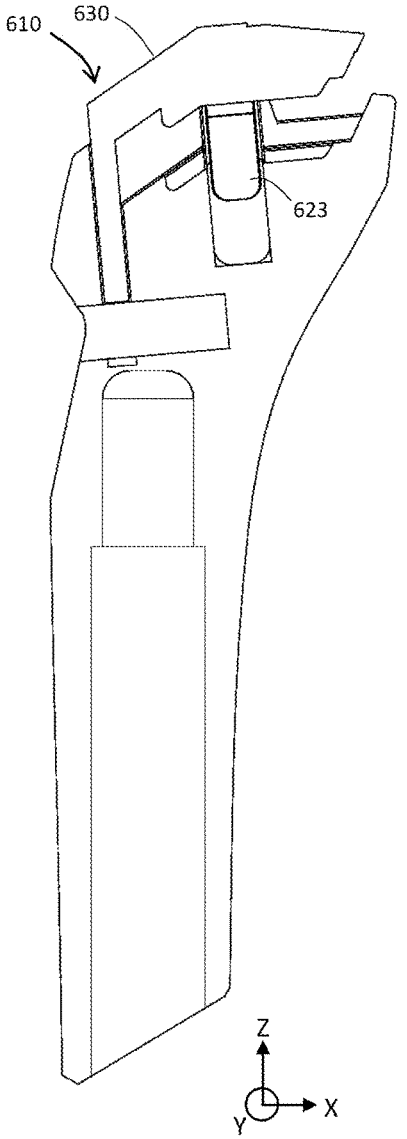
FIG. 12 is a cross-sectional view in profile of a fastening device according to a sixth embodiment of the invention, a locking element of the fastening device being in the unlocked position.
Figure 13:
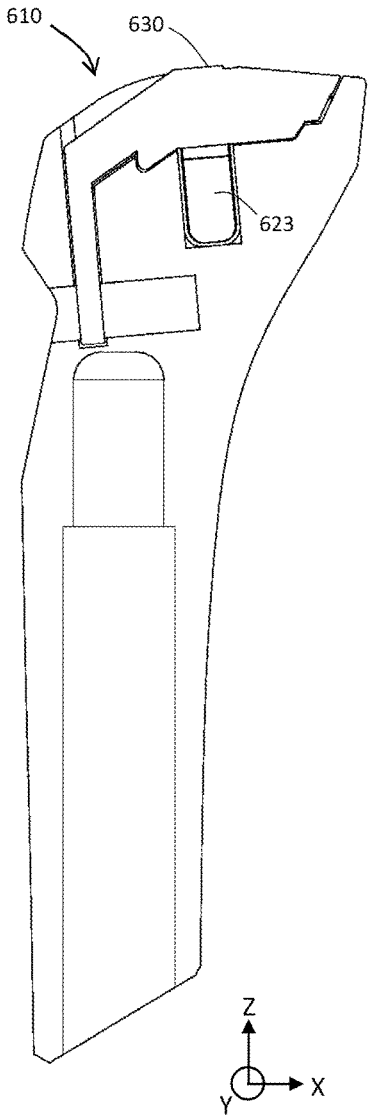
FIG. 13 is a cross-sectional view in profile of the fastening device of FIG. 12, the locking element being in the locked position.
Figure 14:
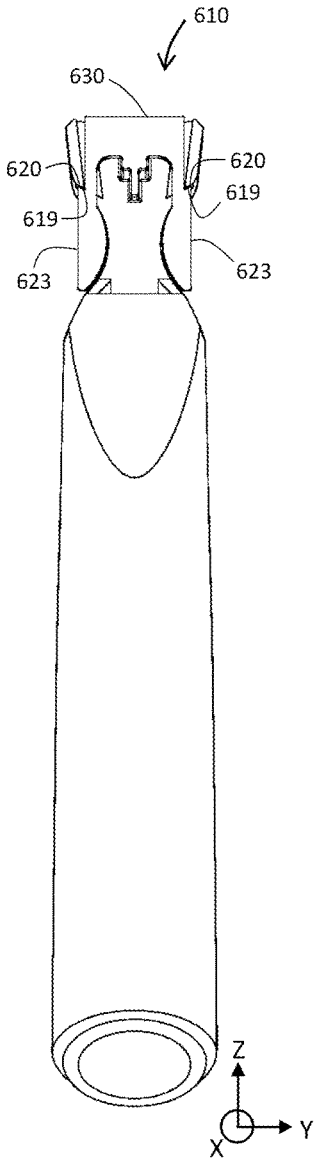
FIG. 14 is a cross-sectional face-on view of the fastening device of FIG. 12, the locking element being in the locked position.

FIGS. 4 and 5 illustrate a ground-contact device according to a second embodiment variant of the invention. FIGS. 6 and 7 illustrate a ground-contact device according to a third embodiment variant of the invention. FIGS. 8 and 9 illustrate a ground-contact device according to a fourth embodiment variant of the invention. FIGS. 10 and 11 illustrate a ground-contact device according to a fifth embodiment variant of the invention. FIGS. 12, 13 and 14 illustrate a ground-contact device according to a sixth embodiment variant of the invention. In order to simplify the description of these embodiments and the studying of the figures, the reference symbols used for describing objects that are identical or equivalent are the same as for the first embodiment, but incremented by 200 for the second variant, by 300 for the third variant, by 400 for the fourth variant, by 500 for the fifth variant, and by 600 for the sixth variant. For example, the handgrip 5 of the first embodiment is thus referenced 205 in the second variant. In addition, only the key differences with respect to the first embodiment are described.

According to the second embodiment, the first bearing surface 223 of the locking element 211, which is to say the bearing surface used for moving the locking element 211 into its unlocked position, is positioned on the front face of the handgrip 205 and is intended to be actuated using the index finger. Conversely, the second bearing surface 230 of the locking element 211, which is to say the bearing surface used for moving the locking element 211 into its locked position, is positioned on the upper face of the handgrip 205 and is intended to be actuated using the thumb. Moreover, the opening 208 accommodating the connecting element comprises a retaining element 232 interacting with the connecting element 7 to hold the connecting element in place in the opening 208 as long as the locking element is in the unlocked position. The retaining element 232 is formed by a protrusion, notably at a lower edge of the opening 208, which may also serve to pre-centre the connecting element 7 of the pole strap, before it is locked by the retaining element 225. This makes the operation of fastening the pole strap to the pole easier. In addition, the locking element 211 also comprises a second elastic tab 233 intended to press against the pin 216. The second elastic tab 233 presses against the pin 216 when the locking element is in its unlocked position. This makes it possible to stabilize the unlocked position of the locking element, which element would otherwise have a tendency to drop down under the effect of gravity. This then makes inserting the connecting element 7 in the opening 208 easier.

According to the third embodiment, the first retaining surface 319 is formed on a rear edge of the appendage 321 rather than on the front edge as it was in the first embodiment. The second retaining surface 320 is formed on a rear edge of the opening 312. Thus, the movement needed in order to move the retaining surfaces 319 and 320 away from one another is a forwards pressure on the appendage 321, rather than a downwards one. This movement can be achieved using the thumb, with the other digits of the hand being wrapped around the handgrip 305.

According to the fourth embodiment, the handgrip 405 is of the cross-country skiing type. It has a shape better suited to the pressures applied in cross-country skiing.

According to the fifth embodiment, the handgrip 505 is likewise of the cross-country skiing type. In addition, the first bearing surface 523 of the locking element 511 is positioned on the front face of the handgrip 505 and is intended to be actuated using the index finger. The second bearing surface 530 of the locking element 511 is positioned on the upper face of the handgrip 505 and is intended to be actuated using the thumb.

According to the sixth embodiment, the fastening device 610 comprises two first retaining surfaces 619 interacting with two second retaining surfaces 620. The fastening device therefore likewise comprises two first bearing surfaces 623. The two first bearing surfaces 623 are situated on the lateral sides of the handgrip 605. The two first bearing surfaces 623 are intended to be actuated by being squeezed between the thumb and index finger with the other digits of the hand being wrapped around the handgrip 605. According to this embodiment, the unlocking of the locking element 611 is even safer still because it requires two pressures to be exerted simultaneously. The second bearing surface 630 is positioned on an upper face of the locking element 611 and is intended to be actuated using the thumb.

The specific features of the various embodiments set out may be freely combined with one another in order to obtain other fastening devices. In each of these embodiments, the locking element is of one-piece, which is to say a single entity. In particular, the body, the retaining element, the elastic portion and the first retaining surface form a monolithic assembly. The locking element is therefore not formed by assembling several parts articulated to one another. Thus, a single element provides both the locking of the connecting element in an opening of the handgrip and the immobilization of this element in this locked position. The locking element may advantageously be manufactured in plastic by injection moulding.

The invention claimed is:

1. A ground-contact device comprising:
- a pole provided with a handgrip,
- a pole strap provided with a connecting element intended to be fastened removably to the handgrip, and
- a locking element mobile relative to the handgrip between a locked position and an unlocked position,
- wherein the locking element comprises:
  - a body,
  - a retaining element connected to the body and able to immobilize the connecting element relative to the handgrip when the locking element is in the locked position, the connecting element being free relative to the handgrip when the locking element is in the unlocked position, and
  - a first retaining surface connected to the body by an elastic portion,
- the handgrip comprising a second retaining surface interacting with the first retaining surface in order to keep the locking element in the locked position, the handgrip comprising an opening adapted to accept the locking element, the second retaining surface being formed on one edge of the opening.

2. The ground-contact device according to claim 1, wherein the locking element comprises an appendage on which the first retaining surface is formed, the appendage further comprising a first bearing surface adapted to be actuated by a user in order to move the first retaining surface away from the second retaining surface.

3. The ground-contact device according to claim 2, wherein the appendage is connected to the body by the elastic portion.

4. The ground-contact device according to claim 3, wherein the first bearing surface is configured to be actuated using an index finger and/or a thumb of one hand of a user, other digits of that same hand being wrapped around the handgrip.

5. The ground-contact device according to claim 4, wherein the opening is a through-opening passing right through the handgrip.

6. The ground-contact device according to claim 3, wherein the opening is a through-opening passing right through the handgrip.

7. The ground-contact device according to claim 2, wherein the first bearing surface is configured to be actuated using an index finger and/or a thumb of one hand of a user, other digits of that same hand being wrapped around the handgrip.

8. The ground-contact device according to claim 2, wherein the opening is a through-opening passing right through the handgrip.

9. The ground-contact device according to claim 1, wherein the opening is a through-opening passing right through the handgrip.

10. The ground-contact device according to claim 1, wherein the locking element comprises a second bearing surface adapted to be actuated by a user in order to move the locking element from the unlocked position to the locked position.

11. The ground-contact device according to claim 10,
wherein the locking element comprises an appendage on which the first retaining surface is formed, the appendage further comprising a first bearing surface adapted to be actuated by a user in order to move the first retaining surface away from the second retaining surface,
wherein the first bearing surface is situated at a first end of the opening, and
wherein the second bearing surface is situated at a second end of the opening, the second end being opposite the first end.

12. The ground-contact device according to claim 10, wherein the second bearing surface is configured to be actuated using a thumb and/or an index finger of a hand of a user, all other digits of the hand being wrapped around the handgrip.

13. The ground-contact device according to claim 1, wherein the elastic portion is an elastic leaf.

14. The ground-contact device according to claim 1, wherein the retaining element has a shape of a finger adapted to be inserted in a hole formed in the connecting element.

15. The ground-contact device according to claim 1, further comprising a stop surface configured to limit the flexing of the elastic portion.

16. The ground-contact device according to claim 1, wherein the locking element is a one-piece element.

17. The ground-contact device according to claim 1, wherein the locking element is translationally mobile relative to the handgrip between the locked position and the unlocked position.

18. The ground-contact device according to claim 1, further comprising mechanical-connection means configured to hold the locking element on the handgrip.

19. The ground-contact device according to claim 1, further comprising a pin secured to the handgrip, the locking element comprising an oblong opening interacting with the pin to limit an amplitude of movement of the locking element relative to the handgrip.

20. A ground-contact device comprising:
a pole provided with a handgrip,
a pole strap provided with a connecting element adapted to be fastened removably to the handgrip, and
a locking element mobile relative to the handgrip between a locked position and an unlocked position,
wherein the locking element comprises:
a body,
a retaining element connected to the body and able to immobilize the connecting element relative to the handgrip when the locking element is in the locked position, the connecting element being free relative to the handgrip when the locking element is in the unlocked position, and
a first retaining surface connected to the body by an elastic portion, the handgrip comprising a second retaining surface interacting with the first retaining surface in order to keep the locking element in the locked position, the locking element comprising an appendage on which the first retaining surface is formed, the appendage further comprising a first bearing surface adapted to be actuated by a user in order to move the first retaining surface away from the second retaining surface, the first bearing surface being a manual-actuation surface accessible to digits of a hand.

* * * * *